United States Patent [19]

Hockaday

[11] 3,939,588

[45] Feb. 24, 1976

[54] LETTERING GUIDE APPARATUS

[76] Inventor: Robert C. Hockaday, 1053 Koohoo Place, Kailua, Hawaii 96734

[22] Filed: June 24, 1974

[21] Appl. No.: 482,656

[52] U.S. Cl. ..... 40/125 A; 33/174 B; 35/37; 40/2.2

[51] Int. Cl.[2] ..... B43L 13/00; G09F 7/00

[58] Field of Search ..... 33/41 B, 174 B; 40/125 A, 40/125 E, 125 F, 2.2; 35/36, 37

[56] References Cited

UNITED STATES PATENTS

| | | | |
|---|---|---|---|
| 2,372,994 | 4/1945 | Welch | 40/125 A |
| 2,391,539 | 12/1945 | Avery | 40/125 A |
| 3,235,969 | 2/1966 | Rose | 33/174 B |

FOREIGN PATENTS OR APPLICATIONS

| | | | |
|---|---|---|---|
| 1,708 | 11/1916 | Netherlands | 35/37 |
| 486,086 | 2/1970 | Switzerland | 40/125 A |
| 238,852 | 1/1960 | Australia | 40/125 A |

*Primary Examiner*—Richard E. Aegerter
*Assistant Examiner*—Richard R. Stearns
*Attorney, Agent, or Firm*—James C. Wray

[57] ABSTRACT

The lettering guide name card has a flat printed area and an area covered by releasable adhesive-mounted parallel strips. Some of the strips are removed to provide lettering spaces, and the remaining strips provide guidelines for lettering.

6 Claims, 4 Drawing Figures

FIG. 1
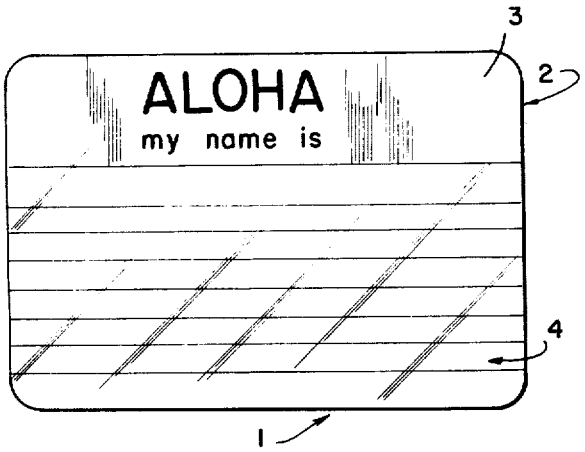
FIG. 2
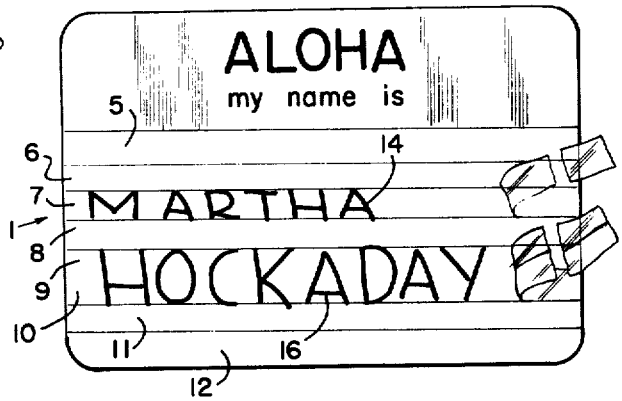
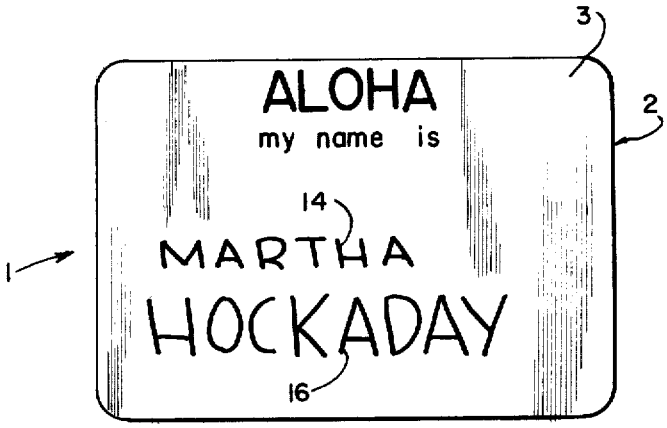
FIG. 3
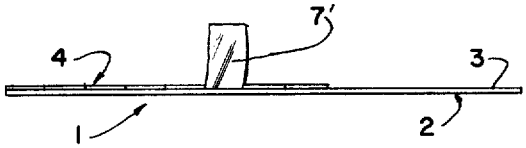
FIG. 4

LETTERING GUIDE APPARATUS

BACKGROUND OF THE INVENTION

The situations in which hand lettering is required are myriad.

In many cases no guides are provided, resulting in inferior, difficult to read, or disfiguring lettering. In some cases light guidelines are provided, resulting in a distraction from the general appearance of the article. In other cases complex separate apparatus is used to provide neatly guided letters. All of the known systems and devices have drawbacks, and it is fair to state that no satisfactory system for providing lettering guides has been devised.

One of the most common situations in which hand lettering is required is in the lettering of name tags for use in business, fraternal or social gatherings. The difficulty of creating good-looking lettering on name tags is well recognized by all who attend such gatherings.

Before preparing an application, a search was caused to be made in the United States Patent Office for lettering guides in class 35 teaching, subclasses 36, 37 and 26, in Class 33, drafting equipment, in Class 283, printed matter, subclasses 45 and 46 and in Class 40, sign exhibiting. We checked our search and results with Patent Office Examiner-experts Grieb and Haroian.

Examples of the closest U.S. Pats. that were found are Nos. 3,638,332; 3,514,874; 2,806,299; 1,253,758; 3,084,455. No suggestion of the present invention was found.

U.S. Pat. No. 3,638,332 is an example of the closest embodiment that was found. Colored lines guide letters. Neither that patent nor any other patent suggests peelable strips.

U.S. Pat. Nos. 3,514,874, 2,806,299 and 1,253,758 describe underpaper fixed guides, lines, slots or crosswires.

Adhesive materials are used in U.S. Pat. No. 3,084,455, but they do not have the function of the peelable lettering guide strips of the present invention.

Other examples of lettering guides are found in Class 33, Class 35, Class 40 and Class 283 of the Official Classification of Patents in the United States Patent Office.

SUMMARY OF THE INVENTION

The present invention overcomes the drawbacks and deficiencies of the prior art and provides a unique solution to problems of lettering.

Briefly, the present invention is a lettering guide with a series of parallel peelable strips. The invention is disclosed in one embodiment herein in its use on a name card. The invention has many other uses wherever lettering is required. For example on engineering drawings, among the many other uses. The invention is useful also as a straight edge to guide lettering tools or drawing tools such as triangles and templates. In the latter embodiment of the invention, parallel peelable strips are provided along a bottom or side edge of a plate, and the strips are used as guides before peeling the strips off at the end of the drawing and lettering operations.

In the embodiment of the invention disclosed herein by way of example, the parallel peelable strips are mounted on a lower area of a front face of a name tag identification card. An upper area of the identification card is left devoid of strips for receiving permanent general lettering. The card may be of any type that is normally used for name tags such as cards with an extended lower portion for inserting in a pocket of a user to expose the upper portion bearing the name, or a flat card to be inserted in a carrier such as a plastic sleeve with a pin on its back, or the more widely used flat card with adhesive on its back face and peelable release strips covering the adhesive until they are removed to expose the adhesive for attachment to the clothing of a user.

The inadequancies of hand lettered labels have been apparent for several years. Store bin identifications, product names, and package markings are often too small and sloppy. Simple personal identification tags are often poorly done because the person doing the job has no time or talent for the task. The present invention makes it possible for anyone to do reasonably neat, accurate lettering or simple drafting the first try at negligible cost on almost any smooth surface using any writing instrument.

The invention consists of lightly gummed masking paper or plastic film which comes in rolls or sheets, on a release paper or film, and which is pre-slit at ⅛ inch, ¼ inch, or whatever interval is desired. It is applied to a smooth surface as the release paper or film is peeled off. Then some of the individual strips are removed, wherever hand lettering ⅛ inch, ¼ inch or other size in multiples of the strip size is desired. The strips which are not removed serve as masks and guides. When the lettering is complete, the balance of the masking strips are removed. The finished job is straight and sharp at top and bottom, and the letters are of perfectly equal height.

In one form of the invention the faces of the strips are smooth or coated, and release paper or film is not necessary when the strips are rolled or layered before use.

The lightly gummed masking paper or plastic film can be slit and applied to card stock, label stock, or sign board and then fabricated into package labels, ID tags, store sign stock, and so forth. Pre-slit masking material on a release paper can be offered in sheets or rolls. In this form it can be applied directly to the surface to be lettered, such as furniture, machinery or equipment.

In another embodiment of the invention, the strips are placed on an object and letters are placed on the strips, using the fine slits as guides. The nonlettered strips may be removed, removing any excessive strokes or ink and leaving perfectly aligned letters on the lettered strips.

One object of this invention is the provision of parallel strips of lightly gummed masking paper or film for attaching to objects to be lettered, whereby neat and even lettering may be accomplished.

Another object of the invention is to provide rolls or sheets of lightly gummed slit parallel strips for attachment to objects to be lettered.

Another object of this invention is the provision of lettering or drawing guides in lightly gummed slit parallel strips for attachment to objects.

Another object of the invention is the provision of lettering apparatus comprising a flat stock plate having a series of parallel individually peelable strips mounted on the plate, and a releasable bonding means connected to the strips on sides thereof adjacent the plate for holding the strips on the plate and for permitting the strips to be pulled from the plate and for leaving adjacent strips on the plate to form guides for lettering on the plate.

The invention has as another object the provision of releasable strips mounted adjacent each other on a portion of a plate.

A further object of the invention is the provision of a name tag with a space on an upper portion of a front face which is devoid of strips for receiving printed letters, and with parallel strips mounted on a lower portion of the front face, whereby some of the strips may be removed to provide spaces for receiving lettering of names with the remaining strips providing guidelines for the lettering.

These and other and further objects and features of the invention are apparent in the disclosure which includes the specification with the claims and the drawings.

BRIEF DESCRIPTION OF THE DRAWINGS

FIG. 1 is a front elevation of a name tag on which an embodiment of the present invention is disclosed.

FIG. 2 is a front elevation of the name tag shown in FIG. 1 from which some strips have been partially removed to expose areas for receiving lettering and on which some strips remain to provide lettering guides.

FIG. 3 is an elevation of the name tag shown in FIG. 2 in which all strips have been removed, completing the name tag.

FIG. 4 is a side view of the name tag shown in FIGS. 1 and 2.

DETAILED DESCRIPTION OF THE DRAWINGS

Referring to FIG. 1, a lettering guide apparatus is generally referred to by the numeral 1. The apparatus has a stock plate 2 which in this case is formed of a general card stock. An upper area 3 on the front face of the card stock is left plain to receive permanent printed letters of general statements or identification. A lower area of the front face has a plurality of parallel peelable strips generally indicated by the numeral 4. Some of the strips 4 are removed to provide lettering areas, and the edges of the remaining strips 4 provide guides for lettering.

As shown in FIG. 2, sequential strips and areas which they cover are numbered sequentially with the numerals 5, 6, 7, 8, 9, 10, 11 and 12. Strips 5 and 6 remain on the card, and the strip in area 7 has been removed to provide a space for lettering. The lower edge of strip 6 acts as an upper lettering guide. Strips have been removed from parallel areas 9 and 10 to provide a space for large letters. Strip 8 remains in place, and its upper edge provides a lower guide for lettering on area 7. The lower edge of strip 8 provides an upper guide for lettering on areas 9 and 10. Strips 11 and 12 are left in place, and the upper edge of strip 11 provides a lower guide for letters in areas 9 and 10.

As shown in FIG. 2, the card has been lettered, with the wearer's name 14 and 16 being lettered in the spaces provided. Where parts of the letters such as the lower portion of the right leg of the last A in the first word 14 and the lower leg of the K in word 16 have been extended beyond the guides, those erroneously extended parts are removed when the remainder of the strips are removed.

FIG. 3 shows all of the card 2 from which all of the strips have been removed to leave the neatly guided letterings 14 and 16.

FIG. 4 is a side view of the lettering apparatus in which strip 7' has been slightly lifted.

While the invention has been described with reference to a specific embodiment, it will be obvious to those skilled in the art that modifications and variations of the invention may be made without departing from the scope of the invention.

I claim:

1. Lettering apparatus comprising a flat card stock lettering plate having a series of parallel individually peelable disposable strips mounted on the plate, and a releasable bonding means connected to the strips on sides thereof adjacent the plate for holding the strips on the plate and for permitting selected strips to be pulled from the plate and for leaving remaining strips on the plate, and surface discontinuities formed between the plate and strips remaining on the plate, whereby the surface discontinuities form guides for lettering on the plate, wherein a first space on a front face of the plate is devoid of the peelable, disposable strips and wherein the peelable, disposable strips are mounted adjacent each other on a second portion of the front face of the plate.

2. The lettering apparatus of claim 1 wherein the plate is a card stock name tag, and wherein the strips are mounted on a portion of a front face of the name tag.

3. The lettering apparatus of claim 2 wherein the card stock name tag has an adhesive on a rear face opposite the strips for fixing to clothing of a user and has a release sheet on the adhesive for protecting the adhesive until the name tag is readied for mounting on the clothing of a user.

4. The lettering apparatus of claim 2 wherein the card stock name tag has a space on an upper portion of a front face which is devoid of strips for receiving printed letters, and wherein the parallel strips are mounted on a lower portion of the front face, whereby some of the strips may be removed to provide spaces for receiving lettering of names with the remaining strips providing guidelines for the lettering.

5. Lettering guide apparatus comprising a relatively rigid lettering plate name card, a series of relatively flexible parallel individually peelable disposable strips joined in sheets comprised of a plurality of said strips on a front face of the card for mounting on the lettering plate name card and releasable bonding means connected to backs of the strips on sides thereof adjacent the lettering plate name card for holding the strips on said name card and for permitting selected strips to be pulled from the lettering plate name card and for leaving remaining strips on the lettering plate name card, thereby creating surface discontinuities between the lettering plate name card and strips remaining on the lettering plate name card, whereby the surface discontinuities form guides for lettering on the lettering plate name card, adhesive means on the back of the name card, and a releasable sheet mounted adjacent the adhesive means on the back of the name card.

6. The lettering guide apparatus of claim 5 wherein the object is a name card with the peelable strips on a front face of the card, and further comprising adhesive means on the back of the name card, a releasable sheet mounted adjacent the adhesive means on the back of the name card.

* * * * *